US006884995B2

(12) United States Patent
Bateman et al.

(10) Patent No.: US 6,884,995 B2
(45) Date of Patent: Apr. 26, 2005

(54) MASS SPECTROMETER

(75) Inventors: Robert Harold Bateman, Knutsford (GB); Kevin Giles, Altrincham (GB); John Brian Hoyes, Stockport (GB); Steve Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/610,677

(22) Filed: Jul. 2, 2003

(65) Prior Publication Data

US 2004/0031916 A1 Feb. 19, 2004

Related U.S. Application Data

(60) Provisional application No. 60/427,561, filed on Nov. 20, 2002.

(30) Foreign Application Priority Data

Jul. 3, 2002 (GB) ..... 0215437
Apr. 11, 2003 (GB) ..... 0308416

(51) Int. Cl.[7] ..... H01J 49/02
(52) U.S. Cl. ..... 250/281; 250/282; 250/288; 250/292
(58) Field of Search ..... 250/281, 282, 250/288, 292

(56) References Cited

U.S. PATENT DOCUMENTS

| | | | |
|---|---|---|---|
| 5,140,158 | A | 8/1992 | Post |
| 5,206,506 | A | 4/1993 | Kirchner |
| 5,572,035 | A | 11/1996 | Franzen |
| 5,811,800 | A | 9/1998 | Franzen et al. |
| 5,818,055 | A | 10/1998 | Franzen |
| 5,847,386 | A | 12/1998 | Thomson et al. |

(Continued)

FOREIGN PATENT DOCUMENTS

| | | |
|---|---|---|
| CA | 2281405 | 3/2000 |
| EP | 0 290 712 | 11/1988 |
| GB | 2 242 309 | 9/1991 |
| GB | 2 242 310 | 9/1991 |
| GB | 2 242 311 | 9/1991 |
| GB | 2 375 653 | 11/2002 |
| JP | 11-307040 | 11/1999 |
| JP | 2000-113852 | 4/2000 |
| JP | 2000-123780 | 4/2000 |
| WO | WO 94/01883 | 1/1994 |
| WO | WO 97/07530 | 2/1997 |
| WO | WO 97/49111 | 12/1997 |
| WO | WO 02/43105 | 5/2002 |

OTHER PUBLICATIONS

Schwager et al., "The Solitron—A New Spectrometer That Uses the Mass Selectivity of a Solitary, Traveling Electric Potential Hill", 42$^{nd}$ ASMS Conference on Mass Spectrometry, pp. 512, 1994.

(Continued)

*Primary Examiner*—Jack I. Berman
(74) *Attorney, Agent, or Firm*—Diederiks & Whitelaw, PLC

(57) ABSTRACT

A mass spectrometer is disclosed comprising a collision cell wherein ions having substantially different mass to charge ratios are arranged to be transmitted through at least a portion of the collision cell at substantially the same time and with substantially the same velocity preferably by means of one or more transient DC voltages or one or more transient DC voltage waveforms which are applied to the electrodes forming the collision cell so that ions are urged through the collision cell at a constant controlled velocity. By appropriate setting of the velocity of the DC voltage or DC voltage waveform passing along the length of the collision cell an efficient collision cell is provided which is able to fragment ions having considerably different mass to charge ratio at substantially the same time in an optimal manner.

92 Claims, 7 Drawing Sheets

U.S. PATENT DOCUMENTS

| | | | | |
|---|---|---|---|---|
| 5,905,258 | A | 5/1999 | Clemmer et al. | |
| 6,107,628 | A | 8/2000 | Smith et al. | |
| 6,111,250 | A | 8/2000 | Thomson et al. | |
| 6,300,627 | B1 | 10/2001 | Köster et al. | |
| 6,403,953 | B2 | 6/2002 | Whitehouse et al. | |
| 6,417,511 | B1 | 7/2002 | Russ, IV et al. | |
| 6,489,610 | B1 | 12/2002 | Barofsky et al. | |
| 6,545,268 | B1 | 4/2003 | Verentchikov et al. | |
| 6,559,444 | B2 | 5/2003 | Franzen | |
| 6,693,276 | B2 * | 2/2004 | Weiss et al. | 250/288 |
| 2001/0032939 | A1 | 10/2001 | Gerlach | |
| 2002/0063207 | A1 | 5/2002 | Bateman et al. | |
| 2002/0063209 | A1 | 5/2002 | Bateman et al. | |
| 2002/0063210 | A1 | 5/2002 | Bateman et al. | |
| 2002/0070338 | A1 | 6/2002 | Loboda | |
| 2002/0079443 | A1 | 6/2002 | Krutchinsky et al. | |
| 2002/0113207 | A1 | 8/2002 | Lee et al. | |
| 2002/0121597 | A1 | 9/2002 | Tanner et al. | |
| 2002/0148959 | A1 | 10/2002 | Weiss et al. | |
| 2004/0041090 | A1 | 3/2004 | Bloomfield et al. | |

OTHER PUBLICATIONS

Teloy et al., "Integral Cross Sections For Ion–Molecule Reactions. I. The Guided Beam Technique", Chemical Physics, vol. 4, pp. 417–427, 1974.

Gerlich et al., "Ion Trap Studies of Association Processes in Collisions of $CH^+_3$ and $CD^+_3$ With n–$H_2$, p–$H_2$, $D_2$, and He at 80 K", The Astrophysical Journal, vol. 347, No. 2, pp. 849–854, 1989.

Guan et al., "Stacked–Ring Electrostatic Ion Guide", J. Am. Soc. for Mass Spectrometry, vol. 7, pp. 101–106, 1996.

Franzen et al., "Electrical Ion Guides", ASMS Book of Abstracts, pp. 1170, 1996.

Shaffer et al., "A Novel Ion Funnel for Ion Focusing at Elevated Pressures", ASMS Book of Abstracts, pp. 375, 1997.

Shaffer et al., "A Novel Ion Funnel for Focusing Ions at Elevated Pressure Using Electrospray Ionization Mass Spectrometry", Rapid Communications in Mass Spectrometry, vol. 11, pp. 1813–1817, 1997.

Shaffer et al., "An Ion Funnel Interface for Improved Ion Focusing and Sensitivity Using Electrospray Ionization Mass Spectrometry", Analytical Chemistry, vol. 70, pp. 4111–4119, 1998.

Shaffer et al., "Characterization of an Improved Electrodynamic Ion Funnel Interface for Electrospray Ionization Mass Spectrometry", Analytical Chemistry, vol. 71, pp. 2957–2964, 1999.

Tolmachev et al., "Charge Capacity Limitations of Radio Frequency Ion Guides in Their Use for Improved Ion Accumulation adn Trapping in Mass Spectrometry", Analytical Chemistry, vol. 72, pp. 970–978, 2000.

Kim et al., "Design and Implementation of a New Electrodynamic Ion Funnel", Analytical Chemistry, vol. 72, pp. 2247–2255, 2000.

Luca et al., "On the Combination of a Linear Field Free Trap With a Time–Of–Flight Mass Spectrometer", Review of Scientific Instruments, vol. 72, No. 7, pp. 2900–2908, 2001.

Giles et al., "Evaluation of a Stacked–Ring Radio Frequency Ion Transmission Device at Intermediate Pressures", ASMS, 2001.

Gerlich, "Inhomogeneous RF Fields: A Versatile Tool For the Study of Proceeses With Slow Ions", Adv. In Chem. Phys. Ser., vol. 82, Ch. 1, pp. 1–176, 1992.

Gerlich, "Rf Ion Guides", Encyclopedia of Mass Spectrometry, vol. 5, Chemistry and Physics of Gas–Phase Ions, pp. 1–34, 2003.

Masuda et al., "Separation of Small Particles Suspended in Liquid by Nonuniform Traveling Field", IEEE Transactions on Industry Applicatons, vol. 1A–23, No. 3, pp. 474–480, 1987.

Masuda et al., "Characteristics of Standing–Wave, Ring-Type Electric Curtain. Experimental Study", Electrical Engineering In Japan, vol. 93, No.1, pp. 78–83, 1973.

Masuda et al., "Approximation For Calculating Nonuniform Traveling Fields", Electrical Engineering in Japan, vol. 96, No. 5, pp. 25–31, 1976.

Masuda, "Approximate Methods For Calculating a NonUniform Travelling Field", Journal of Electrostatics, vol. 1, pp. 351–370, 1975.

Alexander et al., "Transmission Characteristics of a Radio–Frequency–Only Quadrupole Gas–Collision Cell at High Axial Energies in a Hybrid Tandem Mass Spectrometer", Rapid Communications in Mass Spectrometry, vol. 3, No. 10, pp. 364–372, 1989.

Morris et al., "Characterization of a High–Pressure Quadrupole Collision Cell for Low–Energy Collision–Induced Dissociation", J. of Am. Soc. Of Mass Spectrometry, vol. 5, pp. 1042–1063, 1994.

Dodonov et al., "A New Technique for Decomposition of Selected Ions in Molecule Ion Reactor Coupled With Ortho-Time–Of–Flight Mass Spectrometry", Rapid Communications in Mass Spectrometry, vol. 11, pp. 1649–1656, 1997.

Wong et al., "Development of a Totally Computer–Controlled Triple Quadrupole Mass Spectrometer System", Review of Scientific Instruments, vol. 54, pp. 996–1004, 1983.

Beaugrand et al., "Ion Kinetic Energy Measurement in a Tandem Quadrupole Mass Spectrometer", ASMS Book of Abstracts, pp. 209–210, 1987.

Bartlett et al., "Product Ion Nodes in MS/MS", Instrumentation Science and Technology, vol. 22, pp. 301–312, 1994.

Cowen et al., "The Importance of High Impact Parameter Interactions in the Collision Induced Dissoication of Protonated Water Clusters By Argon Using a Wien Velocity Filter", Journal of Chemical Physics, vol. 99, No. 5, pp. 3480–3487, 1993.

Javahery et al., "A Segmented Radiofrequency–Only Quadrupole Collision Cell for Measurements of Ion Collision Cross Section on a Triple Quadrupole Mass Spectrometer", Journal of the Am. Soc. For Mass Spectrometry, vol. 8, pp. 688–696, 1997.

Loboda et al., "Novel Linac II Electrode Geometry for Creating an Axial Field in a Multipole Ion Guide", European Journal of Mass Spectrometry, vol. 6, pp. 531–563, 2000.

* cited by examiner

MASS SPECTROMETER

CROSS-REFERENCE TO RELATED APPLICATIONS

This application claims the benefit of U.S. Provisional Application Ser. No. 60/427,561 filed Nov. 20, 2002.

BACKGROUND OF THE INVENTION

1. Field of the Invention

The present invention relates to a mass spectrometer and a method of mass spectrometry.

2. Discussion of the Prior Art

Organic molecules and biomolecules may be identified by a technique known as MS/MS using a tandem mass spectrometer. Parent ions of interest are selectively transmitted by an upstream mass filter and are then fragmented in a collision cell. The resulting fragment ions are then analysed by a mass analyser downstream of the collision cell.

Known tandem mass spectrometers commonly use a collision cell in which the selected precursor or parent ion are induced to fragment upon colliding with gas molecules in the collision cell. The most common form of collision cell is an enclosed chamber into which gas is introduced. The collision gas is commonly nitrogen or argon, although other gases such as air, helium, xenon, methane or a mixture of gases may be used. The gas pressure is typically in the range $10^{-3}$ mbar to $10^{-2}$ mbar.

The optimum collision energy for fragmentating ions depends upon a number of factors including the mass, charge, composition and internal energy of the ion to be fragmented and the mass of the collision gas. The optimum collision energy for collision induced fragmentation generally increases with the mass of the ion to be fragmented. For singly charged peptide ions formed using a MALDI source and subsequently cooled by collisions with the molecules of a background gas it has been empirically determined that the optimum collision energy (CE) voltage:

$$CE \approx 0.05\ m$$

where m is the mass of the parent ion in daltons. The kinetic energy of an ion is given by:

$$E = \frac{mv^2}{2} = eV$$

where E is the ion energy, m is the mass, v is the velocity of the ion, e is electron charge and V is Volts. Accordingly:

$$v^2 = \frac{2eV}{m}$$

In MKS units and where M is in daltons:

$$v^2 = \frac{2 \times 1.6 \times 10^{-19}}{1.67 \times 10^{-27}} \frac{V}{m} (\text{m/s})^2$$

since electron charge is $1.6\times10^{-19}$ coulombs and 1 dalton is $1.67\times10^{-27}$ kg. According to the empirically determined relationship for singly charged ions the optimum collision energy voltage is approximately equal to the mass in daltons divided by 20 and hence:

$$v^2 = \frac{2 \times 1.6 \times 10^{-19}}{1.67 \times 10^{-27}} \frac{1}{20} (\text{m/s})^2$$

thus:

$$v^2 \approx 10^7 (\text{m/s})^2$$

$$v \approx 3000\ \text{m/s}$$

Hence the optimum collision conditions are conventionally met when ions irrespective of their mass enter a collision cell having e.g. nitrogen or argon collision gas with a velocity of approximately 3000 m/s. Once the ions enter a conventional collision cell then they quickly lose their energy. The empirically determined optimum velocity of approximately 3000 m/s is not therefore an average velocity of the ions travelling through the collision cell but rather corresponds with the velocity that the ions should have upon initially entering the collision cell.

Conventionally it is known to accelerate ions having different masses so that the ions have substantially the same energy prior to entering a collision cell. However, it is not known to accelerate ions having different masses to have substantially the same velocity prior to entering a collision cell.

Conventional collision cell arrangements are therefore unable to fragment a relatively large number of ions having different masses all at substantially the same time and all at substantially the optimum collision energy. The collision energy must either be set at some compromise value which will tend to be less than optimum for some of the ions entering the collision cell or the ions must be arranged to have a collision energy which is progressively increased in a stepped or otherwise scanned manner over an appropriate range of energies. If the range of parent ion masses to be fragmented is relatively large, for example ranging from mass 500 to 2500 daltons, then it is apparent that the ions will be fragmented in a sub-optimal manner.

It is therefore desired to provide a mass spectrometer having an improved fragmentation device.

SUMMARY OF THE INVENTION

According to an aspect of the present invention there is provided a mass spectrometer comprising:

a fragmentation device for fragmenting ions, the fragmentation device comprising a plurality of electrodes wherein in use at least 50%, 60%, 70%, 80%, 90% or 95% of ions having a first mass to charge ratio and at least 50%, 60%, 70%, 80%, 90% or 95% of ions having a second different mass to charge ratio are arranged to be substantially simultaneously transmitted through at least a portion of the fragmentation device at substantially the same first velocity.

The preferred embodiment relates to an AC or RF collision cell with a superimposed DC travelling wave with constant wave velocity.

In use at least 50%, 60%, 70%, 80%, 90% or 95% of ions having mass to charge ratios in between the first mass to charge ratio and the second mass to charge ratio are preferably also substantially simultaneously transmitted through the fragmentation device at substantially the same the first velocity.

The first velocity may be in the range selected from the group consisting of: (i) 500–600 m/s; (ii) 600–700 m/s; (iii) 700–800 m/s; (iv) 800–900 m/s; (v) 900–1000 m/s; (vi) 1000–1100 m/s; (vii) 1100–1200 m/s; (viii) 1200–1300 m/s;

(ix) 1300–1400 m/s; and (x) 1400–1500 m/s. The first velocity may alternatively be in the range selected from the group consisting of: (i) 1500–1600 m/s; (ii) 1600–1700 m/s; (iii) 1700–1800 m/s; (iv) 1800–1900 m/s; (v) 1900–2000 m/s; (vi) 2000–2100 m/s; (vii) 2100–2200 m/s; (viii) 2200–2300 m/s; (ix) 2300–2400 m/s; and (x) 2400–2500 m/s. The first velocity may alternatively be in the range selected from the group consisting of: (i) 2500–2600 m/s; (ii) 2600–2700 m/s; (iii) 2700–2800 m/s; (iv) 2800–2900 m/s; (v) 2900–3000 m/s; (vi) 3000–3100 m/s; (vii) 3100–3200 m/s; (viii) 3200–3300 m/s; (ix) 3300–3400 m/s; and (x) 3400–3500 m/s. The first velocity may alternatively be in the range selected from the group consisting of: (i) 3500–3600 m/s; (ii) 3600–3700 m/s; (iii) 3700–3800 m/s; (iv) 3800–3900 m/s; (v) 3900–4000 m/s; (vi) 4000–4100 m/s; (vii) 4100–4200 m/s; (viii) 4200–4300 m/s; (ix) 4300–4400 m/s; and (x) 4400–4500 m/s. The first velocity could also be in the range selected from the group consisting of: (i) 4500–4600 m/s; (ii) 4600–4700 m/s; (iii) 4700–4800 m/s; (iv) 4800–4900 m/s; (v) 4900–5000 m/s; (vi) 5000–5100 m/s; (vii) 5100–5200 m/s; (viii) 5200–5300 m/s; (ix) 5300–5400 m/s; (x) 5400–5500 m/s; (xi) 5500–5600 m/s; (xii) 5600–5700 m/s; (xiii) 5700–5800 m/s; (xiv) 5800–5900 m/s; (xv) 5900–6000 m/s; and (xvi) >6000 m/s.

The difference between the first mass to charge ratio and the second mass to charge ratio may be preferably at least 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, 2000, 2050, 2100, 2150, 2200, 2250, 2300, 2350, 2400, 2450, 2500, 2550, 2600, 2650, 2700, 2750, 2800, 2850, 2900, 2950 or 3000 mass to charge ratio units.

The ions having the first mass to charge ratio and the ions having the second mass to charge ratio are preferably substantially transmitted through at least 5%, 10%, 15%, 20%, 25%, 30%, 35%, 40%, 45%, 50%, 55%, 60%, 65%, 70%, 75%, 80%, 85%, 90% or 95% of the axial length of the fragmentation device at substantially the same first velocity.

Ions having different mass to charge ratios are preferably substantially simultaneously transmitted in use through the fragmentation device by one or more transient DC voltages or one or more transient DC voltage waveforms which are progressively applied to the electrodes so that ions are urged along the fragmentation device.

In use an axial voltage gradient is preferably maintained along at least a portion of the length of the fragmentation device and wherein the axial voltage gradient varies with time whilst ions are being transmitted through the fragmentation device.

The fragmentation device may comprise at least a first electrode held at a first reference potential, a second electrode held at a second reference potential, and a third electrode held at a third reference potential, wherein: at a first time $t_1$ a first DC voltage is supplied to the first electrode so that the first electrode is held at a first potential above or below the first reference potential; at a second later time $t_2$ a second DC voltage is supplied to the second electrode so that the second electrode is held at a second potential above or below the second reference potential; and at a third later time $t_3$ a third DC voltage is supplied to the third electrode so that the third electrode is held at a third potential above or below the third reference potential.

According to an embodiment at the first time $t_1$ the second electrode is at the second reference potential and the third electrode is at the third reference potential; at the second time $t_2$ the first electrode is at the first potential and the third electrode is at the third reference potential; and at the third time $t_3$ the first electrode is at the first potential and the second electrode is at the second potential.

According to an alternative embodiment at the first time $t_1$ the second electrode is at the second reference potential and the third electrode is at the third reference potential; at the second time $t_2$, the first electrode is no longer supplied with the first DC voltage so that the first electrode is returned to the first reference potential and the third electrode is at the third reference potential; and at the third time $t_3$ the second electrode is no longer supplied with the second DC voltage so that the second electrode is returned to the second reference potential and the first electrode is at the first reference potential.

The first, second and third reference potentials are preferably substantially the same. The first, second and third DC voltages are preferably substantially the same. The first, second and third potentials are preferably substantially the same.

The fragmentation device may comprise 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential.

A plurality of segments-may be maintained at substantially the same DC potential. Preferably, each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

Ions are preferably confined radially within the fragmentation device by an AC or RF electric field. Ions are radially confined within the fragmentation device in a pseudo-potential well and are preferably constrained axially by a real potential barrier or well.

The transit time of ions through the fragmentation device is preferably selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

At least 50%, 60%, 70%, 80%, 90% or 95% of the ions entering the fragmentation device are arranged preferably to have, in use, an energy greater than or equal to 10 eV for a singly charged ion or greater than or equal to 20 eV for a doubly charged ion such that the ions are caused to fragment.

At least 50%, 60%, 70%, 80%, 90% or 95% of the ions entering the fragmentation device are preferably arranged to fragment upon colliding with collision gas within the fragmentation device.

The fragmentation device is preferably maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar. Preferably, the fragmentation device is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar. Preferably, the fragmentation device is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

The fragmentation device is preferably maintained, in use, at a pressure such that a viscous drag is imposed upon ions passing through the fragmentation device.

In use one or more transient DC voltages or one or more transient DC voltage waveforms are preferably initially provided at a first axial position and are then subsequently provided at second, then third different axial positions along the fragmentation device.

One or more transient DC voltages or one or more transient DC voltage waveforms are preferably arranged to move in use from one end of the fragmentation device to another end of the fragmentation device so that ions are urged along the fragmentation device.

The one or more transient DC voltages may create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms preferably comprise a repeating waveform such as a square wave.

The amplitude of the one or more transient DC voltages or the one or more transient DC voltage waveforms preferably remains substantially constant with time. Alternatively, the amplitude of the one or more transient DC voltages or the one or more transient DC voltage waveforms may vary with time. The amplitude of the one or more transient DC voltages or the one or more transient DC voltage waveforms may increase with time, increase then decrease with time, decrease with time or decrease then increase with time.

The fragmentation device may comprise an upstream entrance region, a downstream exit region and an intermediate region, wherein: in the entrance region the amplitude of the one or more transient DC voltages or the one or more transient DC voltage waveforms has a first amplitude; in the intermediate region the amplitude of the one or more transient DC voltages or the one or more transient DC voltage waveforms has a second amplitude; and in the exit region the amplitude of the one or more transient DC voltages or the one or more transient DC voltage waveforms has a third amplitude.

The entrance and/or exit region preferably comprise a proportion of the total axial length of the fragmentation device selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

The first and/or third amplitudes may be substantially zero and the second amplitude may be substantially non-zero. Preferably, the second amplitude is larger than the first amplitude and/or the second amplitude is larger than the third amplitude.

The one or more transient DC voltages or the one or more transient DC voltage waveforms preferably pass in use along the fragmentation device with a second velocity. The second velocity may remain substantially constant, vary, increase, increase then decrease, decrease, decrease then increase, reduce to substantially zero, reverse direction or reduce to substantially zero and then reverse direction.

The difference between the first (ion) velocity and the second (travelling DC voltage wave) velocity is preferably selected from the group consisting of: (i) less than or equal to 50 m/s; (ii) less than or equal to 40 m/s; (iii) less than or equal to 30 m/s; (iv) less than or equal to 20 m/s; (v) less than or equal to 10 m/s; (vi) less than or equal to 5 m/s; and (vii) less than or equal to 1 m/s.

The second velocity is preferably selected from the group consisting of: (i) 500–750 m/s; (ii) 750–1000 m/s; (iii) 1000–1250 m/s; (iv) 1250–1500 m/s; (v) 1500–1750 m/s; (vi) 1750–2000 m/s; (vii) 2000–2250 m/s; (viii) 2250–2500 m/s; (ix) 2500–2750 m/s; (x) 2750–3000 m/s; (xi) 3000–3250 m/s; (xii) 3250–3500 m/s; (xiii) 3500–3750 m/s; (xiv) 3750–4000 m/s; (xv) 4000–4250 m/s; (xvi) 4250–4500 m/s; (xvii) 4500–4750 m/s; (xviii) 4750–5000 m/s; (xix) 5000 m/s–5250 m/s; (xx) 5250–5500 m/s; (xxi) 5500–5750 m/s; and (xxii) 5750–6000 m/s; and (xxiii) >6000 m/s.

The second velocity is preferably substantially the same as the first velocity.

The one or more transient DC voltages or the one or more transient DC voltage waveforms preferably have a frequency, and wherein the frequency: (i) remains substantially constant; (ii) varies; (iii) increases; (iv) increases then decreases; (v) decreases; or (vi) decreases then increases.

The one or more transient DC voltages or the one or more transient DC voltage waveforms preferably have a wavelength, and wherein the wavelength: (i) remains substantially constant; (ii) varies; (iii) increases; (iv) increases then decreases; (v) decreases; or (vi) decreases then increases.

Two or more transient DC voltages or two or more transient DC voltage waveforms may pass simultaneously along the fragmentation device. The two or more transient DC voltages or the two or more transient DC voltage waveforms may move: (i) in the same direction; (ii) in opposite directions; (iii) towards each other; (iv) away from each other.

The one or more transient DC voltages or the one or more transient DC voltage waveforms may be repeatedly generated and passed in use along the fragmentation device, and wherein the frequency of generating the one or more transient DC voltages or the one or more transient DC voltage waveforms: (i) remains substantially constant; (ii) varies; (iii) increases; (iv) increases then decreases; (v) decreases; or (vi) decreases then increases.

In use a continuous beam of ions may be received at an entrance to the fragmentation device. Alternatively, packets of ions may be received at an entrance to the fragmentation device.

Pulses of ions preferably emerge from an exit of the fragmentation device. The mass spectrometer preferably further comprises an ion detector, the ion detector being arranged to be substantially phase locked in use with the pulses of ions emerging from the exit of the fragmentation device. The mass spectrometer may comprise a Time of Flight mass analyser comprising an electrode for injecting ions into a drift region, the electrode being arranged to be energised in use in a substantially synchronised manner with the pulses of ions emerging from the exit of the fragmentation device.

The fragmentation device is preferably selected from the group consisting of: (i) an ion funnel comprising a plurality of electrodes having apertures therein through which ions are transmitted, wherein the diameter of the apertures becomes progressively smaller or larger; (ii) an ion tunnel comprising a plurality of electrodes having apertures therein through which ions are transmitted, wherein the diameter of the apertures remains substantially constant; and (iii) a stack of plate, ringer wire loop electrodes.

The fragmentation device preferably comprises a plurality of electrodes, each electrode having an aperture through which ions are transmitted in use. Each electrode has preferably a substantially circular aperture. Each electrode preferably has a single aperture through which ions are transmitted in use.

The diameter of the apertures of at least 50%, 60%, 70%, 80%, 90% or 95% of the electrodes forming the fragmentation device is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

At least 50%, 60%, 70%, 80%, 90% or 95% of the electrodes forming the fragmentation device preferably have apertures which are substantially the same size or area.

According to another embodiment the fragmentation device may comprise a segmented rod set.

The fragmentation device preferably consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

The thickness of at least 50%, 60%, 70%, 80%, 90% or 95% of the electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

The fragmentation device preferably has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

The fragmentation device preferably comprises a housing having an upstream opening for allowing ions to enter the fragmentation device and a downstream opening for allowing ions to exit the fragmentation device.

The fragmentation device may further comprise an inlet port through which a collision gas is introduced. The collision gas may comprise air and/or one or more inert gases and/or one or more non-inert gases.

Preferably, at least 10%, 20%, 30%, 40%, 50%, 60%, 70%, 80%, 90%, or 95% of the electrodes are connected to both a DC and an AC or RF voltage supply. Axially adjacent electrodes are supplied with AC or RF voltages having a phase difference of 180°.

According to a less preferred embodiment in use one or more AC or RF voltage waveforms may be applied to at least some of the electrodes so that ions are urged along at least a portion of the length of the fragmentation device. The AC or RF voltage waveforms are additional to the AC or RF voltages supplied to the electrodes and which act to radially confine the ions within the fragmentation device but which do not substantially urge ions along the length of the device.

The mass spectrometer preferably comprises an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI) ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

A continuous or pulsed ion source may be provided.

According to another aspect of the present invention there is provided a mass spectrometer comprising:

an ion source;

a mass filter;

a fragmentation device for fragmenting ions, the fragmentation device comprising a plurality of electrodes wherein in use at least 50%, 60%, 70%, 80%, 90% or 95% of ions having a first mass to charge ratio and at least 50%, 60%, 70%, 80%, 90% or 95% of ions having a second different mass to charge ratio are arranged to be substantially simultaneously transmitted through at least a portion of the fragmentation device at substantially the same first velocity; and a mass analyser.

There is preferably further provided an ion guide arranged upstream of the mass filter. The ion guide may comprise a plurality of electrodes wherein at least some of the electrodes are connected to both a DC and an AC or RF voltage supply and wherein one or more transient DC voltages or the one or more transient DC voltage waveforms are passed in use along at least a portion of the length of the ion guide to urge ions along the portion of the length of the ion guide.

The mass filter may comprise a quadrupole rod set mass filter. The mass analyser preferably comprises a Time of Flight mass analyser, a quadrupole mass analyser, a Fourier Transform Ion Cyclotron Resonance ("FTICR") mass analyser, a 2D (linear) quadrupole ion trap or a 3D (Paul) quadrupole ion trap.

According to another aspect of the present invention there is provided a mass spectrometer having a collision cell wherein ions differing in mass to charge ratios by at least 100, 200, 300, 400, 500, 600, 700, 800, 900 or 1000 mass to charge ratio units travel through at least 5%, 10%, 15%, 20%, 25%, 30%, 35%, 40%, 45%, 50%, 55%, 60%, 65%, 70%, 75%, 80%, 85%, 90%, or 95% of the collision cell at substantially the same velocity.

According to another aspect of the present invention there is provided a collision cell wherein, in use, ions having substantially different mass to charge ratios are transmitted through the collision cell at substantially the same velocity.

According to another aspect of the present invention there is provided a method of mass spectrometry comprising:

providing a fragmentation device for fragmenting ions, the fragmentation device comprising a plurality of electrodes; and substantially simultaneously transmitting at least 50%, 60%, 70%, 80%, 90% or 95% of ions having a first mass to charge ratio and at least 50%, 60%, 70%, 80%, 90% or 95% of ions having a second different mass to charge ratio through at least a portion of the fragmentation device at substantially the same first velocity.

According to another aspect of the present invention there is provided a method of mass spectrometry comprising:

providing an ion source, a mass filter, a fragmentation device for fragmenting ions, the fragmentation device comprising a plurality of electrodes and a mass analyser; and substantially simultaneously transmitting at substantially the same first velocity through at least a portion of the fragmentation device at least 50%, 60%, 70%, 80%, 90% or 95% of ions having a first mass to charge ratio and at least 50%, 60%, 70%, 80%, 90% or 95% of ions having a second different mass to charge ratio.

According to another aspect of the present invention there is provided a method of mass spectrometry comprising:

providing a collision cell; and passing ions differing in mass to charge ratios by at least 100, 200, 300, 400, 500, 600, 700, 800, 900 or 1000 mass to charge ratio units through at least 5%, 10%, 15%, 20%, 25%, 30%, 35%, 40%, 45%, 50%, 55%, 60%, 65%, 70%, 75%, 80%, 85%, 90%, or 95% of the collision cell at substantially the same velocity.

According to another aspect of the present invention there is provided a method of mass spectrometry comprising:

providing a collision cell; and transmitting ions having substantially different mass to charge ratios through the collision cell at substantially the same velocity.

According to another aspect of the present invention there is provided a mass spectrometer comprising:

an AC or RF ion guide; and a fragmentation device arranged downstream of the AC or RF ion guide;

wherein in use one or more transient DC voltages or one or more transient DC voltage waveforms are progressively applied to the AC or RF ion guide so that ions having a plurality of different mass to charge ratios are arranged to be transmitted through the ion is guide with substantially the same velocity whereupon the ions are then arranged to enter the fragmentation device with substantially the same velocity and are substantially fragmented.

According to another aspect of the present invention there is provided a method of mass spectrometry comprising:

providing an AC or RF ion guide and a fragmentation device downstream of the AC or RF ion guide; and progressively applying one or more transient DC voltages or one or more transient DC voltage waveforms to the AC or RF ion guide so that ions having a plurality of different mass to charge ratios are transmitted through the ion guide with substantially the same velocity and are then arranged to enter the fragmentation device with substantially the same velocity whereupon they are substantially fragmented.

Preferably, the background gas within the fragmentation device is substantially heavier than the background gas within the AC or RF ion guide.

Preferably, the fragmentation device is maintained at a higher pressure than the AC or RF ion guide. For example, the pressure in the fragmentation device may be at least 10%, 20%, 30%, 40%, 50%, 60%, 70%, 80%, 90%, 100% greater than the pressure within the AC or RF ion guide. According to another embodiment the pressure in the fragmentation device may be at least ×2, ×5, ×10, ×20, ×50, ×100, ×200, ×500, ×1000, ×2000, ×5000, ×10000 times the pressure within the AC or RF ion guide.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
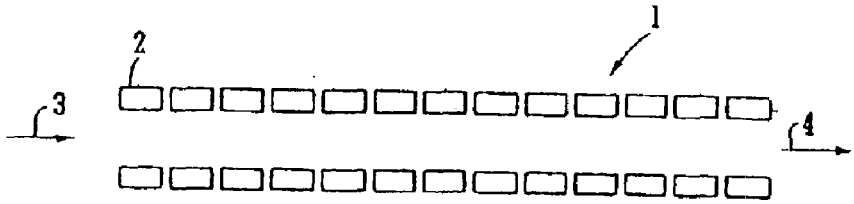
FIG. 1 shows a preferred collision cell.

A preferred embodiment of the present invention will now be described in relation to FIG. 1. A segmented collision cell 1 is provided comprising a plurality of electrodes 2 which may be grouped together into a plurality of segments. Ions are received at an entrance 3 and exit via exit 4. According to one embodiment one or more DC potential barriers/valleys may be translated along the length of the collision cell 1 and a repeating pattern of DC electrical potentials may be superimposed along the length of a segmented collision cell 1 so that a periodic DC voltage waveform is formed. The DC voltage waveform travels along at least part of the collision cell 1 in the direction in which it is required to move the ions at constant velocity.

In the presence of gas at a suitable pressure the ion motion will be dampened by the viscous drag of the gas. The ions will therefore drift forwards with substantially the same velocity as that of the travelling DC waveform which is effectively being translated along the length of the collision cell 1. The ions will therefore travel through the collision cell 1 with approximately the same velocity irrespective of their mass. As will be appreciated, if the ions being transmitted through the collision cell 1 have substantially the same velocity then their kinetic energy will vary in proportion to their mass. Since it has been empirically determined that the optimum collision energy of an ion is also proportional to the mass of the ion then if the travelling wave is set sufficiently fast then the kinetic energy of all the ions may be such that the ions fragment in an optimal manner upon colliding with gas molecules.

It has been found that according to the preferred embodiment when a travelling DC voltage is applied to the collision cell 1 the velocity of the travelling wave necessary to induce fragmentation may be lower than the value of approximately 3000 m/s which applies to conventional collision cells. It has been found, for example, that travelling wave velocities less than 1500 m/s are sufficient to induce fragmentation. It is believed that reason for this is that with collision cell 1 according to the preferred embodiment the ions are maintained at a desired velocity whilst passing through preferably-the whole of the length of the collision cell 1 whereas with a conventional collision cell the ions quickly lose kinetic energy upon entering the collision cell.

According to a less preferred embodiment an AC or RF ion guide may be provided upstream of a collision cell which may be a conventional collision cell or a collision cell 1 according to the preferred embodiment wherein a DC voltage or voltage waveform is applied to the collision cell in order to urge ions along the length of the collision cell 1. The AC or RF ion guide is provided with a travelling DC voltage or voltage waveform such that the velocity of the travelling DC voltage waveform in the AC or RF ion guide is set preferably just below the velocity required to induce fragmentation with the particular gas molecules in the ion guide. However, the ions which are emitted from the AC or RF ion guide and which have substantially the same velocity are then arranged to enter the collision cell, which may according to one embodiment be maintained at a relatively higher pressure than the AC or RF ion guide, wherein the ions are then subject to collision induced decomposition within the collision cell. The energy of each ion entering the gas collision cell will be approximately proportional to its mass and hence the collision energy can be optimised for all ions, simultaneously, irrespective of their mass since it is known that the optimal collision energy is also proportional to the mass of the ion. The collision cell may also or alternatively contain a heavier gas than the AC or RF ion guide so that even if the pressure of the collision cell is substantially similar to that of the AC or RF ion guide, the heavier gas molecules in the collision cell are sufficient to induce fragmentation at the velocities that the ions enter the collision cell at.

The fragmentation device or collision cell 1 according an embodiment may comprise a segmented multipole rod set or more preferably a stacked ring set ("ion tunnel"). The fragmentation device 1 is preferably segmented in the axial direction so that independent transient DC potentials or DC voltage waveforms may be applied to individual segments. The transient DC potential(s) or DC voltage waveforms are preferably superimposed on top of an AC or RF voltage applied to the electrodes which acts to radially confine ions within the collision cell 1. The transient DC potential(s) or voltage waveforms are also preferably superimposed on top of any constant axial DC offset voltage applied to the electrodes 2 which form a constant axial DC voltage gradient. The DC potentials applied to the electrodes 2 may be changed temporally to generate a travelling DC voltage wave in the axial direction.

At any instant in time a voltage gradient is generated between electrodes 2 or segments of the collision cell 1 which has the effect of pushing or pulling ions in a certain direction. As the voltage gradient moves in the required direction so do the ions. The individual DC voltages applied to each of the electrodes 2 or segments is preferably programmed to create a desired DC voltage or DC voltage waveform. Furthermore, the individual DC voltages on each of the electrodes 2 or segments is also preferably programmed to change in synchronism such that the voltage or voltage waveform is preferably maintained but shifted in the direction in which it is required to move the ions.

No static axial DC voltage gradient is required although the travelling DC voltage wave may, less preferably, be provided in conjunction with a constant axial DC voltage gradient. The transient DC voltage or voltage waveform applied to each segment or electrode 2 may be above and/or below that of the constant DC voltage offset to cause movement of the ions in the axial direction.

Figure 2:
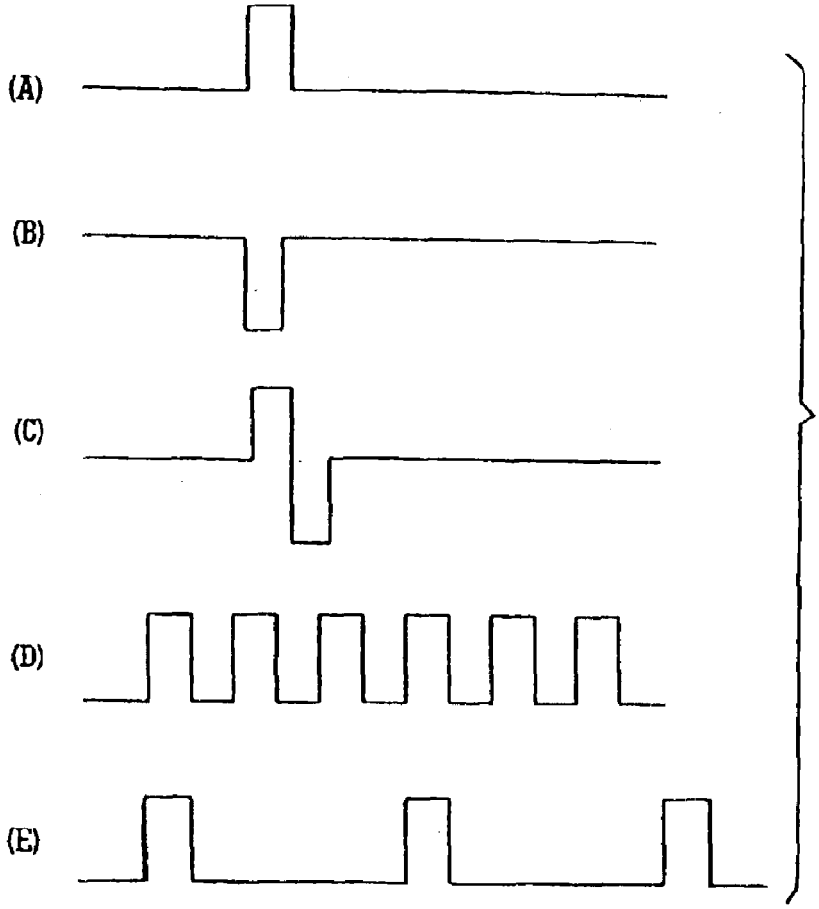
FIG. 2A shows a single potential hill travelling DC voltage.
FIG. 2B shows a single potential well travelling DC voltage.
FIG. 2C shows a combination of a potential hill and potential well travelling DC voltage waveform.
FIG. 2D shows a repeating DC voltage waveform and FIG. 2E shows a yet further repeating DC voltage waveform.
Figure 3:
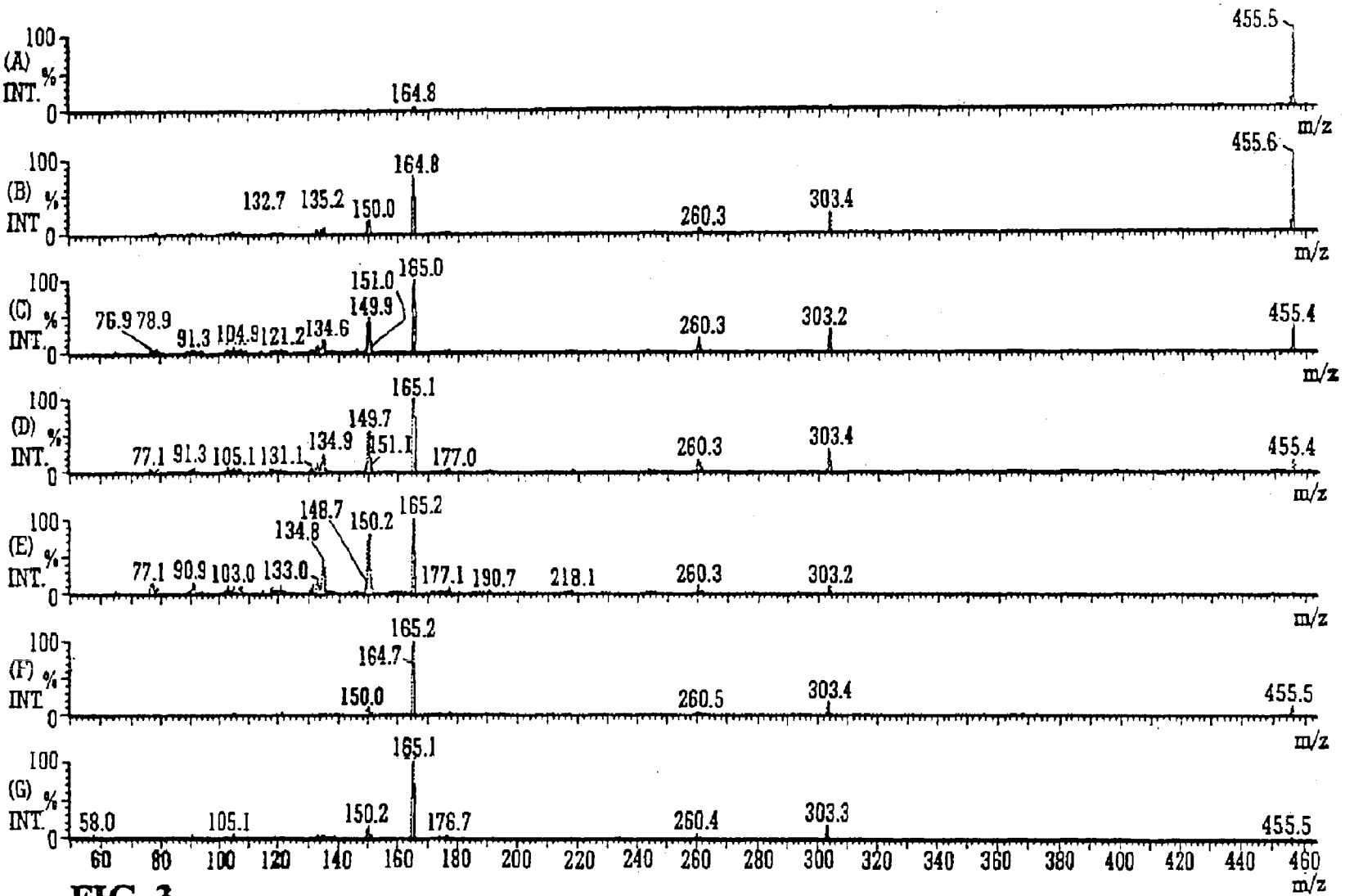
FIG. 3A shows a mass spectrum obtained when Verapamil parent ions having a mass to charge ratio of 455 entered a collision cell having a 150 m/s travelling DC potential waveform with a collision energy of 9 eV.
FIG. 3B shows a mass spectrum obtained when Verapamil parent ions entered a collision cell having a 150 m/s travelling DC potential waveform with a collision energy of 20 eV.
FIG. 3C shows a mass spectrum obtained when Verapamil parent ions entered a collision cell having a 150 m/s travelling DC potential waveform with a collision energy of 26 eV.
FIG. 3D shows a mass spectrum obtained when Verapamil parent ions entered a collision cell having a 150 m/s travelling potential waveform with a collision energy of 29 eV.
FIG. 3E shows a mass spectrum obtained when Verapamil parent ions entered a collision cell having a 150 m/s travelling DC potential waveform with a collision energy of 39 eV.
FIG. 3F shows a mass spectrum obtained when Verapamil parent ions entered a collision cell having a 1500 m/s travelling DC potential waveform according to the preferred embodiment with a collision energy of 2 eV and FIG. 3G shows a mass spectrum obtained when Verapamil parent ions entered a collision cell having a 1500 m/s travelling DC potential waveform according to the preferred embodiment with a collision energy of 10 eV.
Figure 4:
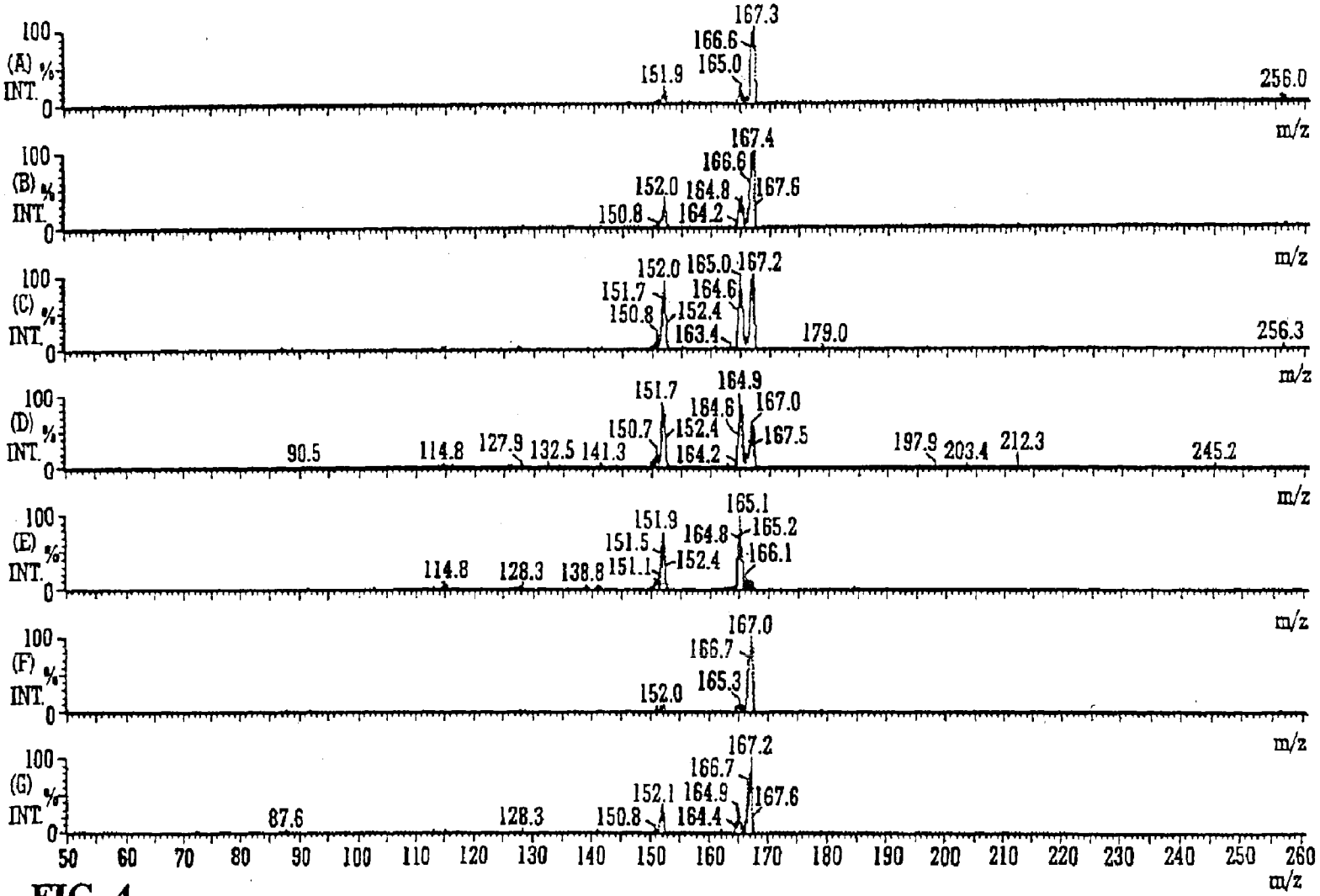
FIG. 4A shows a mass spectrum obtained when diphenhydramine parent ions having a mass to charge ratio of 256 entered a collision cell having a 150 m/s travelling DC potential waveform with a collision energy of 9 eV.
FIG. 4B shows a mass spectrum obtained when diphenhydramine parent ions entered a collision cell having a 150 m/s travelling DC potential waveform with a collision energy of 20 eV.
FIG. 4C shows a mass spectrum obtained when diphenhydramine parent ions entered a collision cell having a 150 m/s travelling DC potential waveform with a collision energy of 26 eV.
FIG. 4D shows a mass spectrum obtained when diphenhydramine parent ions entered a collision cell having a 150 m/s travelling DC potential waveform with a collision energy of 29 eV.
FIG. 4E shows a mass spectrum obtained when diphenhydramine parent ions entered a collision cell having a 150 m/s travelling DC potential waveform with a collision energy of 39 eV.
FIG. 4F shows a mass spectrum obtained when diphenhydramine parent ions entered a collision cell having a 1500 m/s travelling DC potential waveform according to the preferred, embodiment with a collision energy of 2 eV
FIG. 4G shows a mass spectrum obtained when diphenhydramine parent ions entered a collision cell having a 1500 m/s travelling DC potential waveform according to the preferred embodiment with a collision energy of 10 eV.
Figure 5:
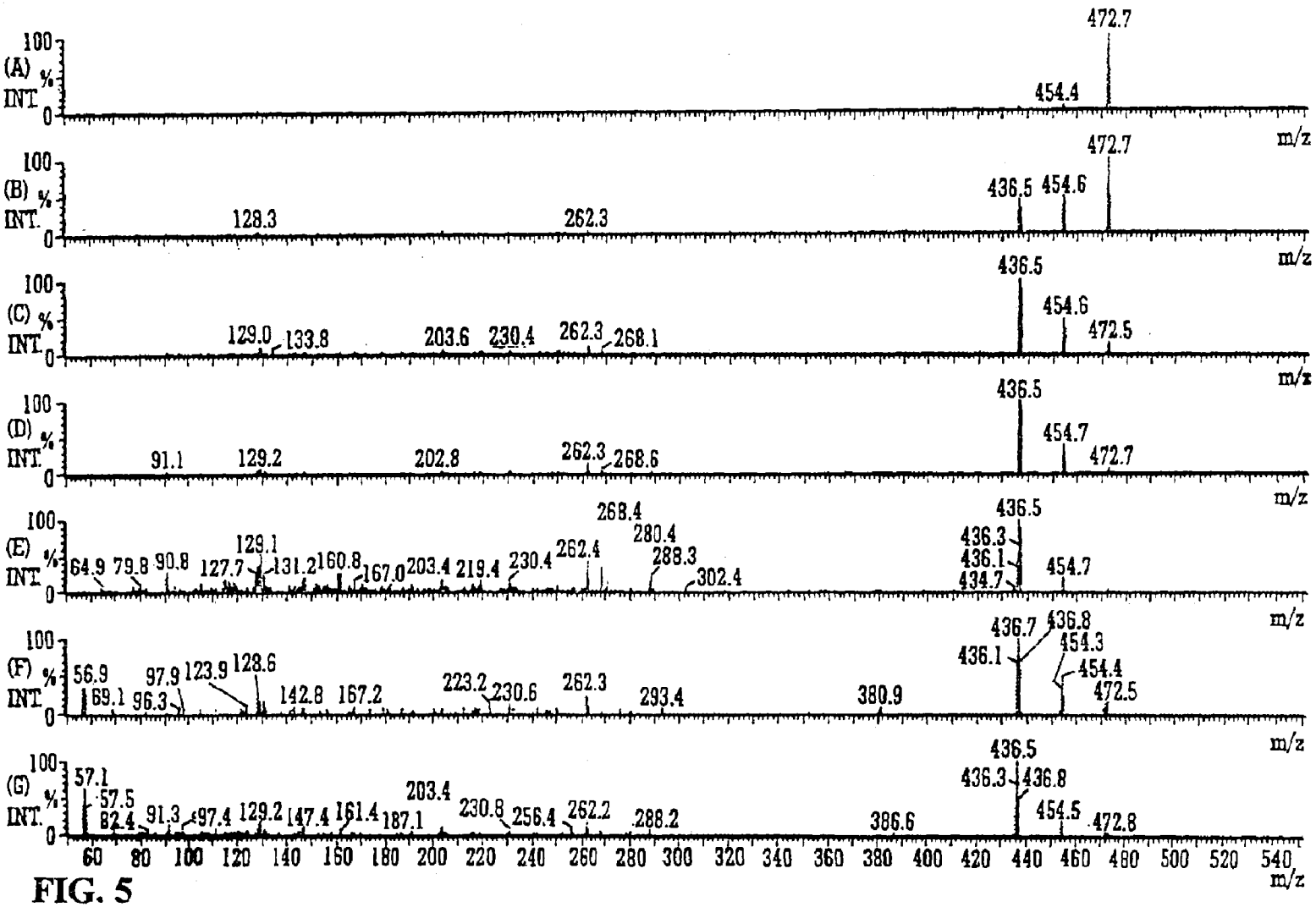
FIG. 5A shows a mass spectrum obtained when terfenadine parent ions having a mass to charge ratio of 472 entered a collision cell having a 150 m/s travelling DC potential waveform with a collision energy of 9 eV.
FIG. 5B shows a mass spectrum obtained when terfenadine parent ions entered a collision cell having a 150 m/s travelling DC potential waveform with a collision energy of 20 eV.
FIG. 5C shows a mass spectrum obtained when terfenadine parent ions entered a collision cell having a 150 m/s travelling DC potential waveform with a collision energy of 26 eV.
FIG. 5D shows a mass spectrum obtained when terfenadine parent ions entered a collision cell having a 150 m/s travelling DC potential waveform with a collision energy of 29 eV.
FIG. 5E shows a mass spectrum obtained when terfenadine parent ions entered a collision cell having a 150 m/s travelling DC potential waveform with a collision energy of 39 eV.
FIG. 5F shows a mass-spectrum obtained when terfenadine parent ions entered a collision cell having a 1500 m/s travelling DC potential waveform according to the preferred embodiment with a collision energy of 2 eV and FIG. 5G shows a mass spectrum obtained when terfenadine parent ions entered a collision cell having a 1500 m/s travelling DC potential waveform according to the preferred embodiment with a collision energy of 10 eV.
Figure 6:
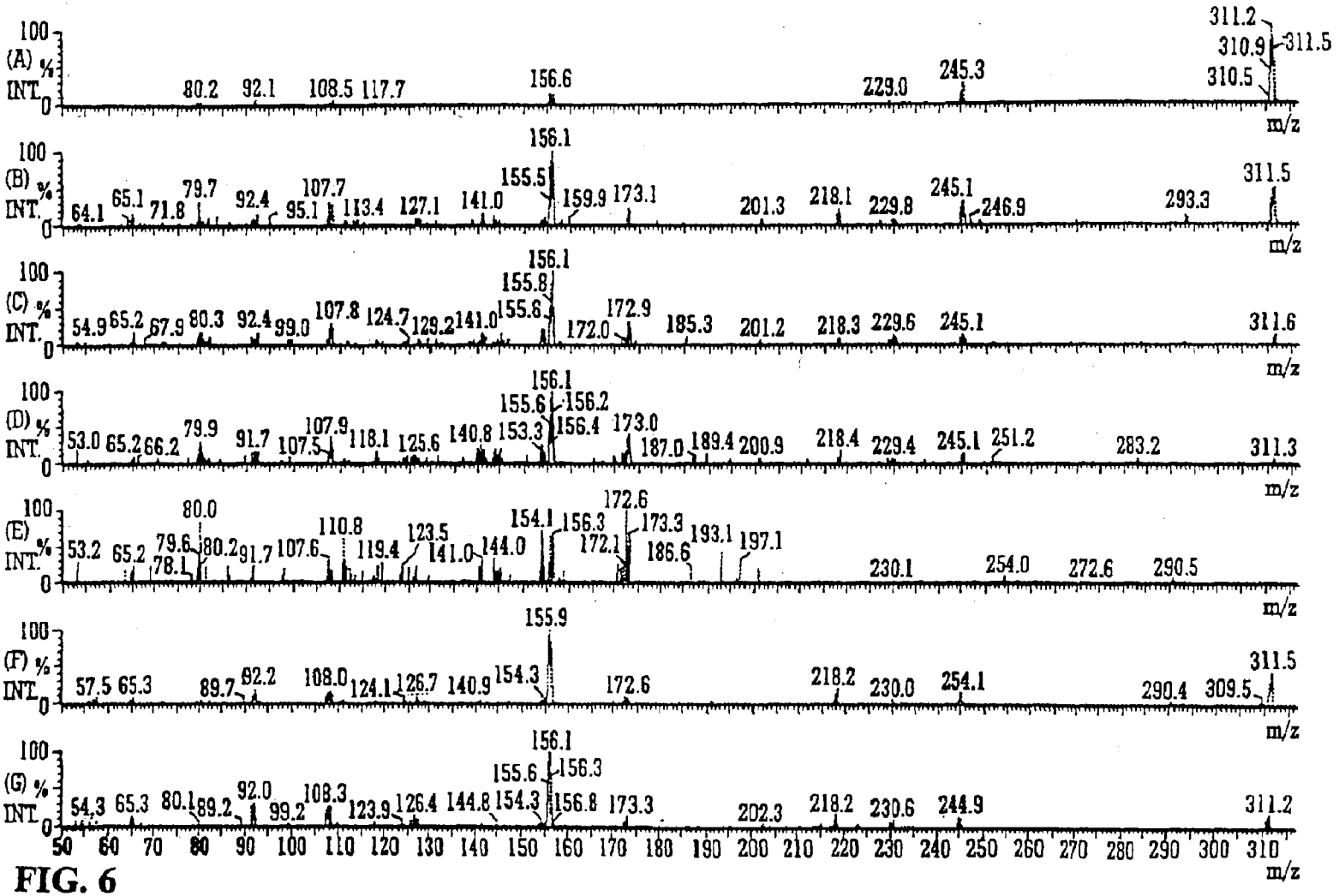
FIG. 6A shows a mass spectrum obtained when sulfadimethoxine parent ions having a mass to charge ratio of 311 entered a collision cell having a 150 m/s travelling DC potential waveform with a collision energy of 9 eV.
FIG. 6B shows a mass spectrum obtained when sulfadimethoxine parent ions entered a collision cell having a 150 m/s travelling DC potential waveform with a collision energy of 20 eV.
FIG. 6C shows a mass spectrum obtained when sulfadimethoxine parent ions entered a collision cell having a 150 m/s travelling DC potential with a collision energy of 26 eV.
FIG. 6D shows a mass spectrum obtained when sulfadimethoxine parent ions entered a collision cell having a 150 m/s travelling DC potential waveform with a collision energy of 29 eV.
FIG. 6E shows a mass spectrum obtained when sulfadimethoxine parent ions entered a collision cell having a 150 m/s travelling DC potential waveform with a collision energy of 39 eV.
FIG. 6F shows a mass spectrum obtained when sulfadimethoxine parent ions entered a collision cell having a 1500 m/s travelling DC potential waveform according to the preferred embodiment with a collision energy of 2 eV and FIG. 6G shows a mass spectrum obtained when sulfadimethoxine parent ions entered a collision cell having a 1500 m/s travelling DC potential waveform according to the preferred embodiment with a collision energy of 10 eV.
Figure 7:
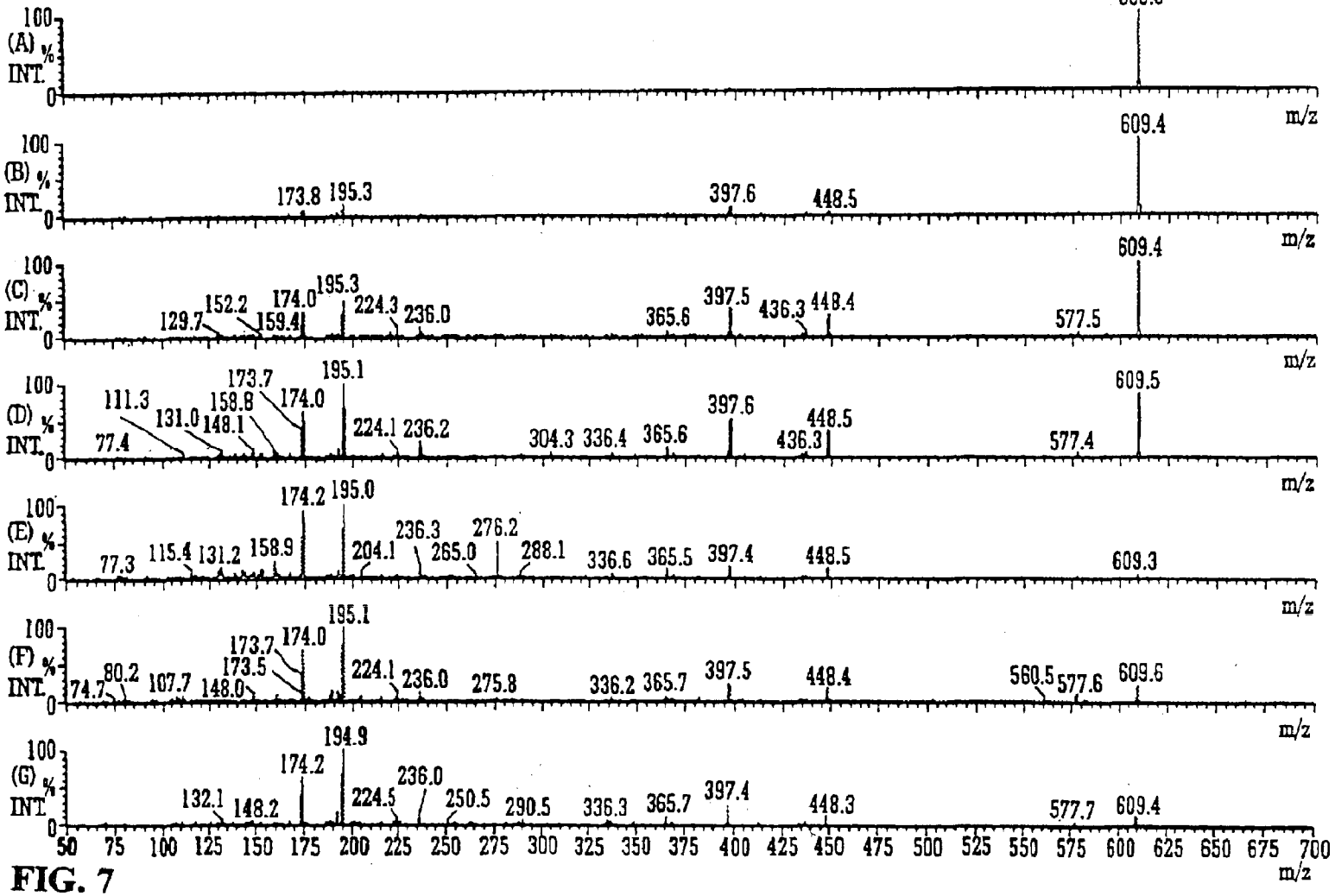
FIG. 7A shows a mass spectrum obtained when reserpine parent ions having a mass to charge ratio of 609 entered a conventional collision cell with a collision energy of 9 eV.
FIG. 7B shows a mass spectrum obtained when reserpine parent ions entered a collision cell having a 150 m/s travelling DC potential waveform with a collision energy of 20 eV.
FIG. 7C shows a mass spectrum obtained when reserpine parent ions entered a collision cell having a 150 m/s travelling DC potential waveform with a collision energy of 26 eV.
FIG. 7D shows a mass spectrum obtained when reserpine parent ions entered a collision cell having a 150 m/s travelling DC potential waveform with a collision energy of 29 eV.
FIG. 7E shows a mass spectrum obtained when reserpine parent ions entered a collision cell having a 150 m/s travelling DC potential waveform with a collision energy of 39 eV.
FIG. 7F shows a mass spectrum obtained when reserpine parent ions entered a collision cell having a 1500 m/s travelling DC potential waveform according to the preferred embodiment with a collision energy of 2 eV and FIG. 7G shows a mass spectrum obtained when reserpine parent ions entered a collision cell having a 1500 m/s travelling DC potential waveform according to the preferred embodiment with a collision energy of 10 eV.

FIGS. 2A–E show five different examples of DC transient voltages or voltage waveforms which may be superimposed on the electrodes 2. FIG. 2A shows a transient DC voltage having a single potential hill or barrier, FIG. 2B shows a transient DC voltage having a single potential well, FIG. 2C shows a transient DC voltage waveform having a single potential well followed by a potential hill or barrier, FIG. 2D shows a transient DC voltage waveform having a repeating potential hill or barrier and FIG. 2E shows a transient DC voltage waveform having periodic pulses.

The DC voltages or voltage waveforms applied to each electrode 2 or segment may be programmed to change continuously or in a series of steps. The sequence of DC voltages applied to each electrode 2 or segment may repeat at regular intervals or at intervals which progressively increase or decrease.

The time over which the complete sequence of voltages is applied over one wavelength of a particular segment is the cycle time T. The inverse of the cycle time is the wave frequency f. The distance along the collision cell 1 over which the voltage waveform repeats itself is the wavelength λ. The wavelength divided by the cycle time is the velocity of the travelling DC voltage wave. Hence, the wave velocity $v_{wave}$:

$$v_{wave} = \frac{\lambda}{T} = \lambda f$$

Under correct operation the velocity v of the ions will be equal to that of the travelling DC voltage or voltage waveform velocity $v_{wave}$. For a given wavelength the wave velocity may be controlled by selection of the cycle time. The preferred velocity of the travelling DC voltage wave may be dependent upon a number of factors including the range of ion masses to be analysed, the pressure and composition of the collision gas and the minimum collision energy required for fragmentation.

The travelling wave collision cell 1 may preferably be used at intermediate pressures between 0.0001 and 100 mbar, more preferably between 0.001 and 10 mbar, further preferably between 0.001 and 0.1 mbar. At such gas densities a viscous drag is imposed on the ions. The gas at these pressures will therefore appear as a viscous medium to the ions and will act to slow the ions. The viscous drag resulting from frequent collisions with gas molecules will prevent the ions from building up excessive velocity. Consequently, the ions will tend to ride on or with the travelling DC voltage wave rather than running ahead of the travelling DC voltage wave and executing excessive oscillations within the travelling potential wells.

The presence of the collision gas imposes a maximum velocity at which the ions will travel through the gas for a given field strength. The higher the gas pressure the more frequent the ion-molecule collisions will be and the slower the ions will travel for a given field strength. The energy of the ions will be dependent upon their mass and the square of their velocity.

It is desirable for the collision energy of singly charged ions in a collision cell to be greater for higher mass ions. Conventionally, if it is required to fragment a number of different precursor ions, each having a different mass at the same time, then it is not possible to set just a single collision energy that is the optimum collision energy for all the different precursor ions having widely varying masses. However, with the collision cell 1 according to the preferred embodiment ions having a wide range of masses can all be arranged to have substantially the same velocity whilst being transmitted through the collision cell 1. If all the ions have approximately the same velocity, irrespective of their mass, then the ion collision energy of the ions will be proportional to its mass. Since it is known empirically that the optimum collision energy is proportional to the mass of the ion then the collision energy can be simultaneously optimised for all ions irrespective of their mass.

The mass spectra shown in FIGS. 3–7 were all obtained using a collision cell 1 comprised of a stack of 122 ring electrodes each 0.5 mm thick and spaced apart by 1.0 mm. The central aperture of each ring was 5.0 mm diameter and the total length of ring stack was 182 mm. A 2.75 MHz RF voltage was applied between neighbouring rings to radially confine the ion beam within the collision cell 1. The pressure in the collision cell 1 was approximately $3.4\times10^{-3}$ mbar. The travelling DC voltage waveform which was applied comprised a regular periodic pulse of constant amplitude and velocity. The travelling DC voltage waveform was generated by applying a transient DC voltage to a pair of ring electrodes and every subsequent ring pair displaced by seven ring pairs along the ring stack. In each ring pair one electrode was maintained at a positive phase of the RF voltage and the other the negative. One wavelength of the DC voltage waveform therefore consisted of two rings with a raised (transient) DC potential followed by twelve rings held at lower (normal) potentials. Thus, the wavelength $\lambda$ was equivalent to 14 rings (21 mm) and the collision cell 1 therefore had a length equivalent to approximately 5.8 $\lambda$.

The travelling DC potential waveform was generated by applying a transient 10 V voltage to each pair of ring electrodes for a given time t before moving the applied voltage to the next pair of ring electrodes. This sequence was repeated uniformly along the length of the collision cell 1. Thus the wave velocity $v_{wave}=\lambda/t$ was equal to 3 mm/t where t is the time that the transient DC voltage was applied to an electrode.

FIGS. 3–7 show CID MS/MS data for a number of compounds at different collision energies with a travelling DC voltage waveform at different travelling wave velocities. The data shows that at relatively low wave travelling wave velocities (e.g. 150 m/s) the collision energy determines the nature of the MS/MS spectrum and optimises at different collision energies for different parent ion masses. However, at higher travelling wave velocities (e.g. 1500 m/s) high collision energy is not required and only one wave velocity is required to induce fragmentation irrespective of parent ion mass.

FIGS. 3A–3G show fragmentation spectra obtained from Verapamil (m/z 455) using different collision energies and two different travelling wave velocities. The travelling wave velocity was 150 m/s for the mass spectra shown in FIGS. 3A–3E and 1500m/s for the mass spectra shown in FIGS. 3F and 3G. The pulse voltage was 10V and the gas cell pressure was $3.4\times10^{-3}$ mbar. The collision energy was 9 eV for the mass spectrum shown in FIG. 3A, 20 eV for the mass spectrum shown in FIG. 3B, 26 eV for the mass spectrum shown in FIG. 3C, 29 eV for the mass spectrum shown in FIG. 3D, 39 eV for the mass spectrum shown in FIG. 3E, 2 eV for the mass spectrum shown in FIG. 3F and 10 eV for the mass spectrum shown in FIG. 3G.

FIGS. 4A–4G show fragmentation spectra obtained from diphenhydramine (m/z 256) using different collision energies and two different travelling wave velocities. The travelling wave velocity was 150 m/s for the mass spectra shown in FIGS. 4A–4E and 1500 m/s for the mass spectra shown in FIGS. 4F and 4G. The pulse voltage was 10V and the gas cell pressure $3.4\times10^{-3}$ mbar. Diphenhydramine is unusual in that it fragments exceptionally easily. It is sometimes used as a test compound to show how gentle a source is. The collision energy was 9 eV for the mass spectrum shown in FIG. 4A, 20 eV for the mass spectrum shown in FIG. 4B, 26 eV for the mass spectrum shown in FIG. 4C, 29 eV for the mass spectrum shown in FIG. 4D, 39 eV for the mass spectrum shown in FIG. 4E, 2 eV for the mass spectrum shown in FIG. 4F and 10 eV for the mass spectrum shown in FIG. 4G.

FIGS. 5A–5G shows fragmentation spectra obtained from terfenadine (m/z 472) using different collision energies and two different travelling wave velocities. The travelling wave velocity was 150 m/s for the mass spectra shown in FIGS. 5A–5E and 1500 m/s for the mass spectra shown in FIGS. 5F and 5G. The pulse voltage was 10V and the gas cell pressure $3.4\times10^{-3}$ mbar. The collision energy was 9 eV for the mass spectrum shown in FIG. 5A, 20 eV for the mass spectrum shown in FIG. 5B, 26 eV for the mass spectrum shown in FIG. 5C, 29 eV for the mass spectrum shown in FIG. 5D, 39 eV for the mass spectrum shown in FIG. 5E, 2 eV for the mass spectrum shown in FIG. 5F and 10 eV for the mass spectrum shown in FIG. 5G.

FIGS. 6A–6G shows fragmentation spectra obtained from sulfadimethoxine (m/z 311) using different collision energies and two different travelling wave velocities. The travelling wave velocity was 150 m/s for the mass spectra shown in FIGS. 6A–6E and 1500 m/s for the mass spectra shown in FIGS. 6F and 6G. The pulse voltage was 10V and the gas cell pressure $3.4\times10^{-3}$ mbar. The collision energy was 9 eV for the mass spectrum shown in FIG. 6A, 20 eV for the mass spectrum shown in FIG. 6B, 26 eV for the mass spectrum shown in FIG. 6C, 29 eV for the mass spectrum shown in FIG. 6D, 39 eV for the mass spectrum shown in FIG. 6E, 2 eV for the mass spectrum shown in FIG. 6F and 10 eV for the mass spectrum shown in FIG. 6G.

Finally, FIGS. 7A–7G shows fragmentation spectra obtained from reserpine (m/z 609) using different collision energies and two different travelling wave velocities. The travelling wave velocity was 150 m/s for the mass spectra shown in FIGS. 7A–7E and 1500 m/s for the mass spectra shown in FIGS. 7F and 7G. The pulse voltage was 10V and the gas cell pressure $3.4\times10^{-3}$ mbar. The collision energy was 9 eV for the mass spectrum shown in FIG. 7A, 20 eV for the mass spectrum shown in FIG. 7B, 26 eV for the mass spectrum shown in FIG. 7C, 29 eV for the mass spectrum shown in FIG. 7D, 39 eV for the mass spectrum shown in FIG. 7E, 2 eV for the mass spectrum shown in FIG. 7F and 10 eV for the mass spectrum shown in FIG. 7G.

Figure 8:
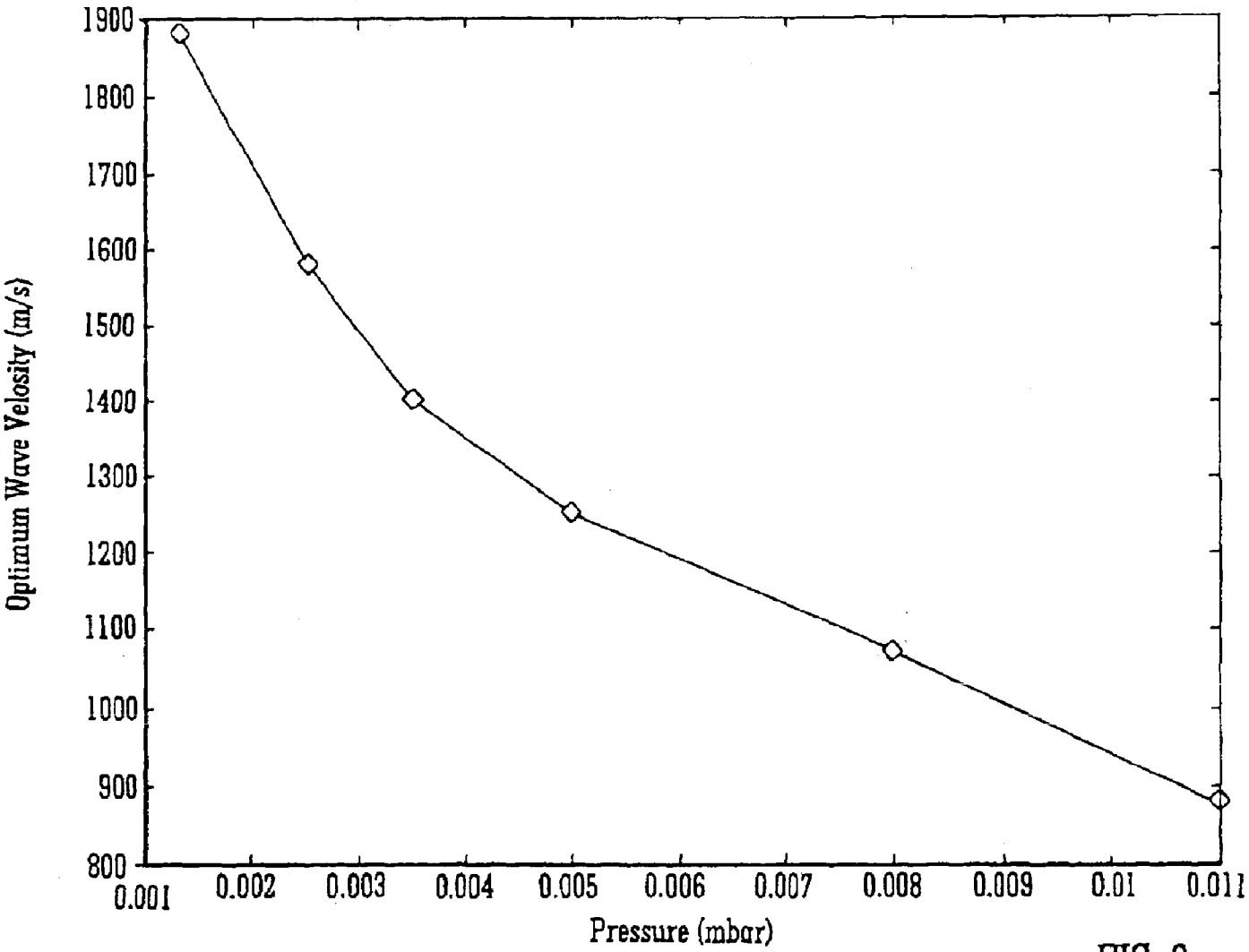
FIG. 8 shows the variation of optimum gas velocity with gas cell pressure for a gas cell length of 185 mm.

A series of experiments were then carried out using a similar collision cell to the one used to obtain the data shown in FIGS. 3–7 to determine the optimum velocity of the travelling DC voltage waveform to give the best degree of fragmentation. Measurements were carried out for several singly and doubly charged ions with mass to charge ratios in the range 200 to 700. The gas collision cell was 185 mm long and the collision gas was Argon. It was observed that the optimum wave velocity was approximately the same for all the ions considered. However, the optimum wave velocity was less than the conventional optimum velocity of 3000 m/s. Furthermore, it was observed that the optimum wave velocity was dependent upon gas pressure and reduced as the pressure increased. FIG. 8 shows the optimum DC voltage travelling waveform velocity for pressures over the range 0.001 to 0.011 mbar. The optimum wave velocity was about 1900 m/s at 0.001 mbar, about 1500 m/s at 0.003 mbar and about 950 m/s at 0.01 mbar.

The conventional empirical rule wherein the collision energy (in Volts) is set to m/20, where m is the mass of the ion, has been found to work quite satisfactorily. The collision energy refers to the energy of the ions as they enter a conventional gas collision cell. In a conventional collision cell the ions undergo multiple collisions and the velocity of the ions will decay approximately exponentially. Hence, the average ion-molecule collision velocity, or collision energy, will be less than that of their initial velocity.

In the case of the preferred collision cell 1 incorporating a travelling DC potential wave the ions will be re-accelerated after losing energy through collisions with gas molecules.

The higher the pressure in the collision cell the shorter the mean free path between ion molecule collisions and therefore the greater the number of collisions. Hence, where a travelling DC voltage waveform exists according to the preferred embodiment to maintain the ion-molecule collision energy, the product of average ion-molecule collision energy and number of collisions will increase as the pressure increases. In such a system, in order to induce optimum fragmentation, it may be expected that the optimum ion-molecule collision velocity will reduce if more collisions take place. In this way the product of average ion-molecule collision energy and number of collisions will remain more constant. Hence, it may be expected that the optimum wave velocity reduces as the pressure increases. The results shown in FIG. 8 support this reasoning.

This is in contrast to a conventional gas cell where no travelling DC voltage waveform exists to maintain the velocity of the ions. Accordingly, ion velocities will decay to an insignificant level after a certain number of collisions and provided the gas pressure and gas cell length is adequate to get to this point the product of average ion-molecule collision velocity and number of collisions will remain fairly constant. Hence, in this situation it may be expected that the optimum collision energy is not so dependent upon the gas pressure.

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a fragmentation device for fragmenting ions, said fragmentation device comprising a plurality of electrodes wherein in use at least 50% of ions having a first mass to charge ratio and at least 50% of ions having a second different mass to charge ratio are arranged to be substantially simultaneously transmitted through at least a portion of said fragmentation device at substantially the same first velocity.

2. A mass spectrometer as claimed in claim 1, wherein in use at least 50% of ions having mass to charge ratios in between said first mass to charge ratio and said second mass to charge ratio are also substantially simultaneously transmitted through said fragmentation device at substantially the same said first velocity.

3. A mass spectrometer as claimed in claim 1, wherein said first velocity is in the range selected from the group consisting of: (i) 500–600 m/s; (ii) 600–700 m/s; (iii) 700–800 m/s; (iv) 800–900 m/s; (v) 900–1000 m/s; (vi) 1000–1100 m/s; (vii) 1100–1200 m/s; (viii) 1200–1300 m/s; (ix) 1300–1400 m/s; and (x) 1400–1500 m/s.

4. A mass spectrometer as claimed in claim 1, wherein said first velocity is in the range selected from the group consisting of: (i) 1500–1600 m/s; (ii) 1600–1700 m/s; (iii) 1700–1800 m/s; (iv) 1800–1900 m/s; (v) 1900–2000 m/s; (vi) 2000–2100 m/s; (vii) 2100–2200 m/s; (viii) 2200–2300 m/s; (ix) 2300–2400 m/s; and (x) 2400–2500 m/s.

5. A mass spectrometer as claimed in claim 1, wherein said first velocity is in the range selected from the group consisting of: (i) 2500–2600 m/s; (ii) 2600–2700 m/s; (iii) 2700–2800 m/s; (iv) 2800–2900 m/s; (v) 2900–3000 m/s; (vi) 3000–3100 m/s; (vii) 3100–3200 m/s; (viii) 3200–3300 m/s; (ix) 3300–3400 m/s; and (x) 3400–3500 m/s.

6. A mass spectrometer as claimed in claim 1, wherein said first velocity is in the range selected from the group consisting of: (i) 3500–3600 m/s; (ii) 3600–3700 m/s; (iii) 3700–3800 m/s; (iv) 3800–3900 m/s; (v) 3900–4000 m/s; (vi) 4000–4100 m/s; (vii) 4100–4200 m/s; (viii) 4200–4300 m/s; (ix) 4300–4400 m/s; and (x) 4400–4500 m/s.

7. A mass spectrometer as claimed in claim 1, wherein said first velocity is in the range selected from the group consisting of: (i) 4500–4600 m/s; (ii) 4600–4700 m/s; (iii) 4700–4800 m/s; (iv) 4800–4900 m/s; (v) 4900–5000 m/s; (vi) 5000–5100 m/s; (vii) 5100–5200 m/s; (viii) 5200–5300 m/s; (ix) 5300–5400 m/s; (x) 5400–5500 m/s; (xi) 5500–5600 m/s; (xii) 5600–5700 m/s; (xiii) 5700–5800 m/s; (xiv) 5800–5900 m/s; (xv) 5900–6000 m/s; and (xvi)>6000 m/s.

8. A mass spectrometer as claimed in claim 1, wherein the difference between said first mass to charge ratio and said second mass to charge ratio is at least 50, 100, 150, 200, 250, 300, 350, 400, 450, 500, 550, 600, 650, 700, 750, 800, 850, 900, 950 or 1000 mass to charge ratio units.

9. A mass spectrometer as claimed in claim 1, wherein the difference between said first mass to charge ratio and said second mass to charge ratio is at least 1050, 1100, 1150, 1200, 1250, 1300, 1350, 1400, 1450, 1500, 1550, 1600, 1650, 1700, 1750, 1800, 1850, 1900, 1950 or 2000 mass to charge ratio units.

10. A mass spectrometer as claimed in claim 1, wherein the difference between said first mass to charge ratio and said second mass to charge ratio is at least 2050, 2100, 2150, 2200, 2250, 2300, 2350, 2400, 2450, 2500, 2550, 2600, 2650, 2700, 2750, 2800, 2850, 2900, 2950 or 3000 mass to charge ratio units.

11. A mass spectrometer as claimed in claim 1, wherein said ions having said first mass to charge ratio and said ions having said second mass to charge ratio are substantially transmitted through at least 5% of the axial length of said fragmentation device at substantially the same first velocity.

12. A mass spectrometer as claimed in claim 1, wherein ions having different mass to charge ratios are substantially simultaneously transmitted in use through said fragmentation device by one or more transient DC voltages or one or more transient DC voltage waveforms which are progressively applied to said electrodes so that ions are urged along said fragmentation device.

13. A mass spectrometer as claimed in claim 1, wherein in use an axial voltage gradient is maintained along at least a portion of the length of said fragmentation device and wherein said axial voltage gradient varies with time whilst ions are being transmitted through said fragmentation device.

14. A mass spectrometer as claimed in claim 1, wherein said fragmentation device comprises at least a first electrode held at a first reference potential, a second electrode held at a second reference potential, and a third electrode held at a third reference potential, wherein:

at a first time $t_1$ a first DC voltage is supplied to said first electrode so that said first electrode is held at a first potential above or below said first reference potential;

at a second later time $t_2$ a second DC voltage is supplied to said second electrode so that said second electrode is held at a second potential above or below said second reference potential; and at a third later time $t_3$ a third DC voltage is supplied to said third electrode so that said third electrode is held at a third potential above or below said third reference potential.

15. A mass spectrometer as claimed in claim 14, wherein:

at said first time $t_1$ said second electrode is at said second reference potential and said third electrode is at said third reference potential;

at said second time $t_2$ said first electrode is at said first potential and said third electrode is at said third reference potential; and at said third time $t_3$ said first electrode is at said first potential and said second electrode is at said second potential.

16. A mass spectrometer as claimed in claim 14, wherein at said first time $t_1$ said second electrode is at said second reference potential and said third electrode is at said third reference potential;

at said second time $t_2$ said first electrode is no longer supplied with said first DC voltage so that said first electrode is returned to said first reference potential and said third electrode is at said third reference potential; and at said third time $t_3$ said second electrode is no longer supplied with said second DC voltage so that said second electrode is returned to said second reference potential and said first electrode is at said first reference potential.

17. A mass spectrometer as claimed in claim 14, wherein said first, second and third reference potentials are substantially the same.

18. A mass spectrometer as claimed in claim 14, wherein said first, second and third DC voltages are substantially the same.

19. A mass spectrometer as claimed in claim 14, wherein said first, second and third potentials are substantially the same.

20. A mass spectrometer as claimed in claim 1, wherein said fragmentation device comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential.

21. A mass spectrometer as claimed in claim 20, wherein a plurality of segments are maintained at substantially the same DC potential.

22. A mass spectrometer as claimed in claim 20, wherein each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

23. A mass spectrometer as claimed in claim 1, wherein ions are confined radially within said fragmentation device by an AC or RF electric field.

24. A mass spectrometer as claimed in claim 1, wherein ions are radially confined within said fragmentation device in a pseudo-potential well and are constrained axially by a real potential barrier or well.

25. A mass spectrometer as claimed in claim 1, wherein the transit time of ions through said fragmentation device is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

26. A mass spectrometer as claimed in claim 1, wherein at least 50%, of the ions entering said fragmentation device are arranged to have, in use, an energy greater than or equal to 10 eV for a singly charged ion or greater than or equal to 20 eV for a doubly charged ion such that said ions are caused to fragment.

27. A mass spectrometer as claimed in claim 1, wherein at least 50% of the ions entering said fragmentation device are arranged to fragment upon colliding with collision gas within said fragmentation device.

28. A mass spectrometer as claimed in claim 1, wherein said fragmentation device is maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

29. A mass spectrometer as claimed in claim 1, wherein said fragmentation device is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

30. A mass spectrometer as claimed in claim 1, wherein said fragmentation device is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

31. A mass spectrometer as claimed in claim 1, wherein said fragmentation device is maintained, in use, at a pressure such that a viscous drag is imposed upon ions passing through said fragmentation device.

32. A mass spectrometer as claimed in claim 1, wherein in use one or more transient DC voltages or one or more transient DC voltage waveforms are initially provided at a first axial position and are then subsequently provided at second, then third different axial positions along said fragmentation device.

33. A mass spectrometer as claimed in claim 1, wherein one or more transient DC voltages or one or more transient DC voltage waveforms are arranged to move in use from one end of said fragmentation device to another end of said fragmentation device so that ions are urged along said fragmentation device.

34. A mass spectrometer as claimed in claim 32, wherein said one or more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

35. A mass spectrometer as claimed in claim 32, wherein said one or more transient DC voltage waveforms comprise a repeating waveform.

36. A mass spectrometer as claimed in claim 35, wherein said one or more transient DC voltage waveforms comprise a square wave.

37. A mass spectrometer as claimed in claim 32, wherein the amplitude of said one or more transient DC voltages or said one or more transient DC voltage waveforms remains substantially constant with time.

38. A mass spectrometer as claimed in claim 32, wherein the amplitude of said one or more transient DC voltages or said one or more transient DC voltage waveforms varies with time.

39. A mass spectrometer as claimed in claim 38, wherein the amplitude of said one or more transient DC voltages or said one or more transient DC voltage waveforms: (i) increases with time; (ii) increases then decreases with time; (iii) decreases with time; or (iv) decreases then increases with time.

40. A mass spectrometer as claimed in claim 1, wherein said fragmentation device comprises an upstream entrance region, a downstream exit region and an intermediate region, wherein:

in said entrance region the amplitude of one or more transient DC voltages or one or more transient DC voltage waveforms has a first amplitude;

in said intermediate region the amplitude of one or more transient DC voltages or one or more transient DC voltage waveforms has a second amplitude; and in said exit region the amplitude of one or more transient DC voltages or one or more transient DC voltage waveforms has a third amplitude.

41. A mass spectrometer as claimed in claim 40, wherein the entrance and/or exit region comprise a proportion of the total axial length of said fragmentation device selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

42. A mass spectrometer as claimed in claim 40, wherein said first and/or third amplitudes are substantially zero and said second amplitude is substantially non-zero.

43. A mass spectrometer as claimed in claim 40, wherein said second amplitude is larger than said first amplitude and/or said second amplitude is larger than said third amplitude.

44. A mass spectrometer as claimed in claim 1, wherein one or more transient DC voltages or said one or more transient DC voltage waveforms pass in use along said fragmentation device with a second velocity.

45. A mass spectrometer as claimed in claim 44, wherein said second velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

46. A mass spectrometer as claimed in claim 44, wherein the difference between said first velocity and said second velocity is selected from the group consisting of: (i) less than or equal to 50 m/s; (ii) less than or equal to 40 m/s; (iii) less than or equal to 30 m/s; (iv) less than or equal to 20 m/s; (v) less than or equal to 10 m/s; (vi) less than or equal to 5 m/s; and (vii) less than or equal to 1 m/s.

47. A mass spectrometer as claimed in claim 44, wherein said second velocity is selected from the group consisting of: (i) 500–750 m/s; (ii) 750–1000 m/s; (iii) 1000–1250 m/s; (iv) 1250–1500 m/s; (v) 1500–1750 m/s; (vi) 1750–2000 m/s; (vii) 2000–2250 m/s; (viii) 2250–2500 m/s; (ix) 2500–2750 m/s; (x) 2750–3000 m/s; (xi) 3000–3250 m/s; (xii) 3250–3500 m/s; (xiii) 3500–3750 m/s; (xiv) 3750–4000 m/s; (xv) 4000–4250 m/s; (xvi) 4250–4500 m/s; (xvii) 4500–4750 m/s; (xviii) 4750–5000 m/s; (xix) 5000 m/s–5250 m/s; (xx) 5250–5500 m/s; (xxi) 5500–5750 m/s; and (xxii) 5750–6000 m/s; and (xxiii)>6000 m/s.

48. A mass spectrometer as claimed in claim 44, wherein said second velocity is substantially the same as said first velocity.

49. A mass spectrometer as claimed in claim 1, wherein one or more transient DC voltages or said one or more transient DC voltage waveforms has a frequency, and wherein said frequency: (i) remains substantially constant; (ii) varies; (iii) increases; (iv) increases then decreases; (v) decreases; or (vi) decreases then increases.

50. A mass spectrometer as claimed in claim 1, wherein one or more transient DC voltages or one or more transient DC voltage waveforms has a wavelength, and wherein said wavelength: (i) remains substantially constant; (ii) varies; (iii) increases; (iv) increases then decreases; (v) decreases; or (vi) decreases then increases.

51. A mass spectrometer as claimed in claim 1, wherein two or more transient DC voltages or two or more transient DC voltage waveforms pass simultaneously along said fragmentation device.

52. A mass spectrometer as claimed in claim 51, wherein said two or more transient DC voltages or said two or more transient DC voltage waveforms move: (i) in the same direction; (ii) in opposite directions; (iii) towards each other; (iv) away from each other.

53. A mass spectrometer as claimed in claim 1, wherein one or more transient DC voltages or one or more transient DC voltage waveforms are repeatedly generated and passed in use along said fragmentation device, and wherein the frequency of generating said one or more transient DC voltages or said one or more transient DC voltage waveforms: (i) remains substantially constant; (ii) varies; (iii) increases; (iv) increases then decreases; (v) decreases; or (vi) decreases then increases.

54. A mass spectrometer as claimed in claim 1, wherein in use a continuous beam of ions is received at an entrance to said fragmentation device.

55. A mass spectrometer as claimed in claim 1, wherein in use packets of ions are received at an entrance to said fragmentation device.

56. A mass spectrometer as claimed in claim 1, wherein in use pulses of ions emerge from an exit of said fragmentation device.

57. A mass spectrometer as claimed in claim 56, further comprising an ion detector, said ion detector being arranged to be substantially phase locked in use with the pulses of ions emerging from the exit of said fragmentation device.

58. A mass spectrometer as claimed in claim 56, further comprising a Time of Flight mass analyser comprising an electrode for injecting ions into a drift region, said electrode being arranged to be energised in use in a substantially synchronised manner with the pulses of ions emerging from the exit of said fragmentation device.

59. A mass spectrometer as claimed in claim 1, wherein said fragmentation device is selected from the group consisting of: (i) an ion funnel comprising a plurality of electrodes having apertures therein through which ions are transmitted, wherein the diameter of said apertures becomes progressively smaller or larger; (ii) an ion tunnel comprising a plurality of electrodes having apertures therein through which ions are transmitted, wherein the diameter of said apertures remains substantially constant; and (iii) a stack of plate, ring or wire loop electrodes.

60. A mass spectrometer as claimed in claim 1, wherein said fragmentation device comprises a plurality of electrodes, each electrode having an aperture through which ions are transmitted in use.

61. A mass spectrometer as claimed in claim 1, wherein each electrode has a substantially circular aperture.

62. A mass spectrometer as claimed in claim 1, wherein each electrode has a single aperture through which ions are transmitted in use.

63. A mass spectrometer as claimed in claim 60, wherein the diameter of the apertures of at least 50% of the electrodes forming said fragmentation device is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

64. A mass spectrometer as claimed in claim 1, wherein at least 50% of the electrodes forming the fragmentation device have apertures which are substantially the same size or area.

65. A mass spectrometer as claimed in claim 1, wherein said fragmentation device comprises a segmented rod set.

66. A mass spectrometer as claimed in claim 1, wherein said fragmentation device consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

67. A mass spectrometer as claimed in claim 1, wherein the thickness of at least 50% of said electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

68. A mass spectrometer as claimed in claim 1, wherein said fragmentation device has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

69. A mass spectrometer as claimed in claim 1, wherein said fragmentation device comprises a housing having an upstream opening for allowing ions to enter said fragmentation device and a downstream opening for allowing ions to exit said fragmentation device.

70. A mass spectrometer as claimed in claim 69, wherein the fragmentation device further comprises an inlet port through which a collision gas is introduced.

71. A mass spectrometer as claimed in claim 70, wherein said collision gas comprises air and/or one or more inert gases and/or one or more non-inert gases.

72. A mass spectrometer as claimed in claim 1, wherein at least 10% of said electrodes are connected to both a DC and an AC or RF voltage supply.

73. A mass spectrometer as claimed in claim 1, wherein axially adjacent electrodes are supplied with AC or RF voltages having a phase difference of 180°.

74. A mass spectrometer as claimed in claim 1, wherein in use one or more AC or RF voltage waveforms are applied to at least some of said electrodes so that ions are urged along at least a portion of the length of said fragmentation device.

75. A mass spectrometer as claimed in claim 1, further comprising an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI) ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

76. A mass spectrometer as claimed in claim 1, further comprising a continuous ion source.

77. A mass spectrometer as claimed in claim 1, further comprising a pulsed ion source.

78. A mass spectrometer comprising:

an ion source;

a mass filter;

a fragmentation device for fragmenting ions, said fragmentation device comprising a plurality of electrodes wherein in use at least 50% of ions having a first mass to charge ratio and at least 50% of ions having a second different mass to charge ratio are arranged to be substantially simultaneously transmitted through at least a portion of said fragmentation device at substantially the same first velocity; and a mass analyser.

79. A mass spectrometer as claimed in claim 78, further comprising an ion guide arranged upstream of said mass filter.

80. A mass spectrometer as claimed in claim 79, wherein said ion guide comprises a plurality of electrodes wherein at least some of said electrodes are connected to both a DC and an AC or RF voltage supply and wherein one or more transient DC voltages or said one or more transient DC voltage waveforms are passed in use along at least a portion of the length of said ion guide to urge ions along said portion of the length of said ion guide.

81. A mass spectrometer as claimed in claim 78, wherein said mass filter comprises a quadrupole mass filter.

82. A mass spectrometer as claimed in claim 78, wherein said mass analyser comprises a Time of Flight mass analyser, a quadrupole mass analyser, a Fourier Transform Ion Cyclotron Resonance ("FTICR") mass analyser, a 2D (linear) quadrupole ion trap or a 3D (Paul) quadrupole ion trap.

83. A mass spectrometer comprising a collision cell wherein, in use, ions differing in mass to charge ratios by at least 100 mass to charge ratio units travel through at least 5% of said collision cell at substantially the same velocity.

84. A method of mass spectrometry comprising:

providing a fragmentation device for fragmenting ions, said fragmentation device comprising a plurality of electrodes; and substantially simultaneously transmitting at least 50% of ions having a first mass to charge ratio and at least 50% of ions having a second different mass to charge ratio through at least a portion of said fragmentation device at substantially the same first velocity.

85. A method of mass spectrometry comprising:

providing an ion source, a mass filter, a fragmentation device for fragmenting ions, said fragmentation device comprising a plurality of electrodes and a mass analyser; and substantially simultaneously transmitting at substantially the same first velocity through at least a portion of said fragmentation device at least 50% of ions having a first mass to charge ratio and at least 50% of ions having a second different mass to charge ratio.

86. A method of mass spectrometry comprising:

providing a collision cell; and passing ions differing in mass to charge ratios by at least 100 mass to charge ratio units through at least 5% of said collision cell at substantially the same velocity.

87. A mass spectrometer comprising:

an AC or RF ion guide; and a fragmentation device arranged downstream of said AC or RF ion guide;

wherein in use one or more transient DC voltages or one or more transient DC voltage waveforms are progressively applied to said AC or RF ion guide so that ions having a plurality of different mass to charge ratios are arranged to be transmitted through said ion guide with substantially the same velocity whereupon said ions are then arranged to enter said fragmentation device with substantially the same velocity and are substantially fragmented.

88. A mass spectrometer as claimed in claim 87, wherein a first background gas is present in use within said fragmentation device and a second background gas is present in use within said AC or RF ion guide and wherein the first background gas is substantially heavier than the second background gas.

89. A mass spectrometer as claimed in claim 87, wherein said fragmentation device is maintained in use at a substantially higher pressure than said AC or RF ion guide.

90. A method of mass spectrometry comprising:

providing an AC or RF ion guide and a fragmentation device downstream of said AC or RF ion guide; and progressively applying one or more transient DC voltages or one or more transient DC voltage waveforms to said AC or RF ion guide so that ions having a plurality of different mass to charge ratios are transmitted through said ion guide with substantially the same velocity and are then arranged to enter said fragmentation device with substantially the same velocity whereupon they are substantially fragmented.

91. A method as claimed in claim 90, wherein a first background gas is present in use within said fragmentation device and a second background gas is present in use within said AC or RF ion guide and wherein the first background gas is substantially heavier than the second background gas.

92. A method as claimed in claim 90, wherein said fragmentation device is maintained in use at a substantially higher pressure than said AC or RF ion guide.

* * * * *